US005503200A

United States Patent [19]

Lea

[11] Patent Number: 5,503,200

[45] Date of Patent: Apr. 2, 1996

[54] SHAFT TAPERING DEVICE

[76] Inventor: Michael F. Lea, 2109 Summit St., Columbus, Ohio 43201

[21] Appl. No.: 261,734

[22] Filed: Jun. 17, 1994

[51] Int. Cl.[6] ..... B27C 7/06; B27C 7/00

[52] U.S. Cl. ..... 142/38; 142/49; 142/56; 30/481

[58] Field of Search ..... 142/27, 31, 32, 142/38, 42, 49, 55, 56; 144/205, 206; 30/481

[56] References Cited

U.S. PATENT DOCUMENTS

| | | | |
|---|---|---|---|
| 14,173 | 1/1856 | Webber | 142/58 |
| 68,064 | 8/1967 | Gifford | 82/57 |
| 83,573 | 10/1868 | Whitlock | 142/56 |
| 232,634 | 9/1980 | Durgin | 142/56 |
| 619,519 | 2/1899 | Fosby | 142/56 |
| 2,049,685 | 8/1936 | Brown | 142/56 |
| 2,764,187 | 9/1956 | Zemrowski | 142/56 |
| 2,848,020 | 8/1958 | Zemrowski | 142/56 |
| 2,913,019 | 11/1959 | Sprague | 142/49 |
| 3,229,731 | 1/1966 | Hilton | 142/56 |
| 3,771,392 | 11/1973 | Johnson | 82/157 |
| 4,372,356 | 2/1983 | Conklin | 142/56 |
| 4,497,352 | 2/1985 | Lippolt | 142/48 |

FOREIGN PATENT DOCUMENTS

| | | | |
|---|---|---|---|
| 43853 | 9/1915 | Sweden | 142/56 |
| 143779 | 11/1930 | Switzerland | 142/56 |

*Primary Examiner*—Steven C. Bishop
*Attorney, Agent, or Firm*—Edward E. Schilling

[57] ABSTRACT

A shaft tapering device having a body block with a transverse borehole through which the shaft to be tapered is introduced. A recess in the top of the body block intersects the borehole, forming an aperture into which a cutting blade extends substantially tangential to the curvature of the borehole. A cradle attached to the body block includes a pair of parallel wing-like members spaced apart by spreaders at each end of the wings, which are pivotably mounted to the body block. Each wing has a notch formed in the upper edge thereof that is semicircular in the deepest part and on pivoting the wings the deepest part of the notches can be substantially aligned with the borehole. On holding a handle attached to the body block, pivoting the wings during rotation of a workpiece, and moving the device laterally, the work piece is quickly and controllably tapered, the notches in the wings of the cradle bringing the work piece to the cutting blade with the work piece substantially centered under the cutting edge at all times. A portable kit combines the tapering device with a guide frame having a longitudinal way joining a head stock with a tail stock, and with a tapering template extending between the two. A template follower attached to the forward spreader of the cradle rides on the template and automatically pivots the cradle as the device is slid along the way as the work piece is rotated by a drill motor mounted on the head stock.

20 Claims, 4 Drawing Sheets

SHAFT TAPERING DEVICE

FIELD OF THE INVENTION

The invention relates to a device useful for making a shaft or rod of any-material that can be turned on a lathe, such as, wood or polymeric material or metal, whether of uniform diameter, or of uniform taper, or of controllably random taper, to a method of tapering and to apparatus for conveniently controlling the taper.

BACKGROUND OF THE INVENTION

A number of devices and apparatuses have been patented that may be used to make dowels and shafts of various types, including tapered shafts, usually from wooden work stock. There are also devices for shaving, e.g., dowels, to custom fit them. These ordinarily require the use of a lathe for rotating the work piece, and usually make use of a rigid frame called a longitudinal way or bed with a driving head with a driven chuck at one end and an idler tail head or tail stock at the other end. Usually, there is also provided a tool rest that mounts on the way or bed and is movable along the way or bed. As an example, there is the apparatus of Johnson, U.S. Pat. No. 3,771,392, who describes a tool rest and tool holder, but not means for quickly and conveniently moving the tool holder along the longitudinal way, and especially not in a reproducible manner from work piece to work piece.

None of the patented devices, so far as is known presently, provides adequate means for easily and accurately controlling the taper of the work piece, especially of a shaft longer than several inches, and also lacking is means for conveniently keeping the work piece centered under the leading edge of the cutting blade at all times while being worked. The device of Lippolt, U.S. Pat. No. 4,497,352, appears to make some provision for approximate centering of the work piece as it is forced into the unsymmetrical V-shaped groove of the stationary block, but the provisions for tapering are not very convenient to carry out in practice, and not quickly done.

The patents to Hilton, U.S. Pat. No. 3,229,731; Sprague, U.S. Pat. No. 2,913,019; Zemrowski, U.S. Pat. No. 2,848,020; and Durgin, U.S. Pat. No. 232,634; each describe devices for turning shafts in which a support bar or a second blade serves as a spacer defining the diameter of the shaft obtained, with adjustment means. But the adjustment means are not easily adjusted so that is it neither easy nor convenient to make a tapered shaft, and certainly not quickly.

Other turning tools are described by Gifford, U.S. Pat. No. 68,064 and Webber, U.S. Pat. No. 14,173.

There is also a need to provide apparatus for making tapered shafts up to at least three inches or more in diameter that is not only convenient to use, but modest in cost, and, portable if desired, especially for the making of shafts of wood or other light turnable material up to at least an inch in diameter and up to about six feet in length or longer, and also, to make all such shafts reproducibly, if desired.

SUMMARY OF THE INVENTION

In a first aspect the invention is a shaft tapering device made up of a body block, usually a substantially rectangular solid, with a transverse borehole and an aperture from the top side intercepting the borehole and having provisions for mounting a cutting blade to extend slightly and operatively into the borehole; a guiding cradle longer than the body block and having arms pivotably mounted, one arm on each lateral side of the body block, for guiding the work piece; and a handle rigidly attached to the rear portion of the body block for manual or other control thereof.

The arms of the guiding cradle are joined at their respective ends by spacers or spreaders and are pivotably attached at about their mid-length to the lateral sides of the body block. Each arm is provided with guide means in the form of a J-shaped notch or equivalent-acting structure such as a loop of heavy gauge wire, for supportively guiding the work piece being worked on to the cutting blade.

Each guide means, i.e., each notch or equivalent structure, is shaped semicircularly in the deepest part, and on pivoting the guiding cradle, e.g., from a horizontal position, downwardly with respect to the front side of the body block, the semicircular deepest parts are alignable with the borehole of the body block and are usually selected to be of the same or similar diameter and must be large enough to accommodate the initial size of the work piece.

When the semicircular deepest part of each J-shaped notch or equivalent is aligned with the adjacent borehole the notch may be seen to be positioned at an angle to the top side of the body block with the edge defining the back side of the notch corresponding to the long leg of the "J" at an angle of about 40 to 45 degrees to the top side of the body block, and especially to a line drawn between the top of the borehole and the point about which the arms pivot.

The front defining edge of each J-shaped notch or equivalent structure, i.e., the edge facing in the direction of the handle of the device, is about tangential with the semicircular part, flaring away somewhat from the tangential line and extending up with very slight curvature to reach the top side of the body block at an angle of about 83 to about 88 degrees.

The pivotal arms each pivot about a point on the body block between the borehole and the rear side of the body block, and about at the level of the top of the borehole, and spaced from the nearest edge of the borehole a distance about equal to the diameter of the borehole.

When the device is appropriately assembled, a work piece being rotated and tapered by the cutting blade as the cradle is tipped upwardly with respect to the front of the body block, e.g., by hand pressure being placed on the rear spreader if done manually, will be guided or advanced towards the cutting blade with the center of rotation of the work piece being consistently just under about the leading edge of the cutting blade. With no work piece in the device, when the front of the cradle is tilted upwardly so that the deepest part of the notch passes across the borehole, as the deepest part is not quite past the borehole, the remaining clear "sight" or passage visible through the borehole will be looking substantially right across the leading edge of the cutting blade.

Preferably the arms of the guiding cradle take the form of wings cut from metal plate that may be generally rectangular in shape but are more preferably each rounded convexly along the bottom edge like a rocker of a rocking chair, and about straight across the upper edge except for the notch. Most preferably, the rear portions are somewhat upswept to avoid having the rear Spreader come down awkwardly close to the handle when the front of the cradle is tipped upwardly during tapering operations, though the handle may also be attached to extend downwardly from the rear of the body block.

In another embodiment of the present device, the bottom side of the body block is provided with an aperture communicating with a portion of the bottom of the borehole, generally the width of the cutting blade, for the ready discharge of shavings or turnings, the aperture also reducing the weight of the body block.

While the cradle may be pivoted manually in use without a guide, it is highly convenient to employ with the present tapering device a novel tapering guide having a longitudinal way joining a head stock and a tail stock which support a tapering template member and, usually, to incorporate in the guide apparatus the drive means for rotating the work piece. Such a tapering guide consists of an elongated frame, generally rectangular, and readily made of wood, structural plastic or light metal, that joins the head stock and the tail stock which in turn support the tapering template member at a longitudinal tilt. The template member serves as a guide for the pivoting of the cradle in order to get the taper sought to be obtained. A template follower, usually in the form of a simple rod or bar, is rigidly attached extending forwardly from the spreader at the distal end of the cradle. The spreader must not be rotatable in its mount.

The frame includes a way or bed for the present novel tapering device to ride upon with the spacing from the tapering template member being such that the follower rod is readily held manually or mechanically against the upper surface of the template rod as the tapering device is slid along the way while the work piece is rotated and turned to size in the tapering operation.

Usually the frame includes means at one end thereof for mounting power means for holding and rotating the work piece. In many cases the power means may be a conventional one-quarter inch or three-eighths inch drill motor which is simply, and often releasably, clamped to the frame with the chuck extending through an aperture in the head stock.

The frame of the tapering guide consists of the head stock and a tail stock connected by at least one elongated spacing member that slides adjustably through or past the head stock and tail stock. A support for the motor used as rotational power means is provided on the outer face of the head stock and positioned so that the chuck will extend easily through an aperture in the head stock and be accessible for mounting a work piece. A corresponding aperture is provided in the tail stock for the work piece to extend through to limit any gyrations thereof. At the back edges of the head stock and tail stock are provided also means for clamping the respective ends of the template rod employed. In the case uniform taper is desired, the tapering template member is simply a straight rod positioned to incline or tilt upwardly to the requisite extent needed to pivot the cradle to get the amount of taper desired. Preferably a straight edged member is positioned between the head stock and the tail stock at about the bottom edges thereof to serve as a convenient support for the present shaft tapering device as it is moved along the work piece during tapering operations.

The shaft tapering device and the tapering guide together constitute a convenient, useful kit that is readily made to be portable for most operations.

DETAILED DESCRIPTION OF THE INVENTION

Figure 1:
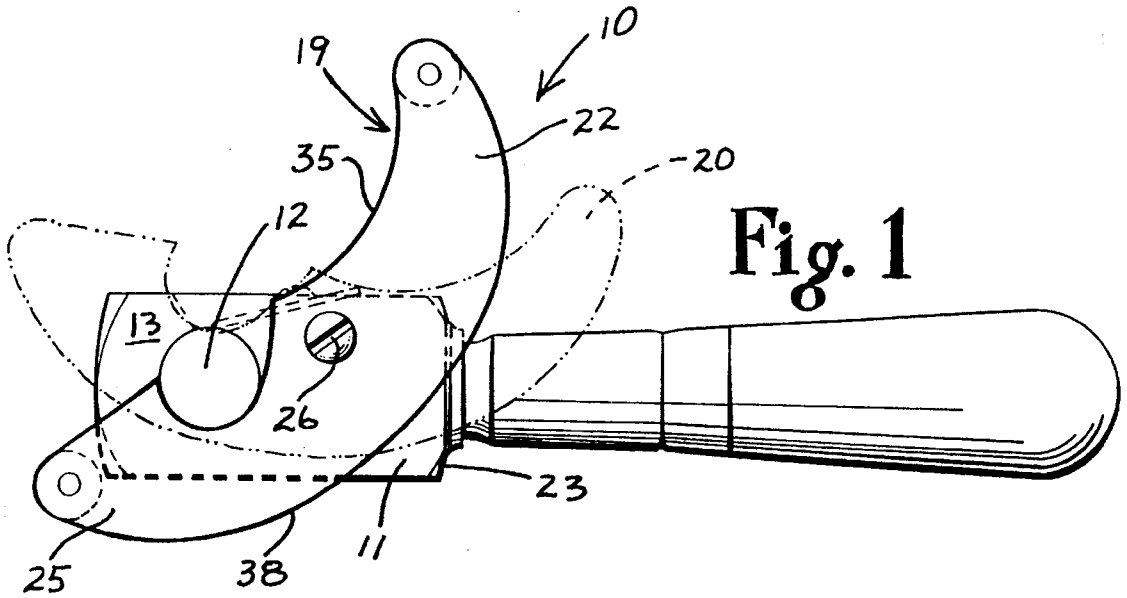
FIG. 1 is a left side elevation of the shaft tapering device of the invention showing the cradle in full, and, in dotted outline in a pivoted position.
Figure 2:
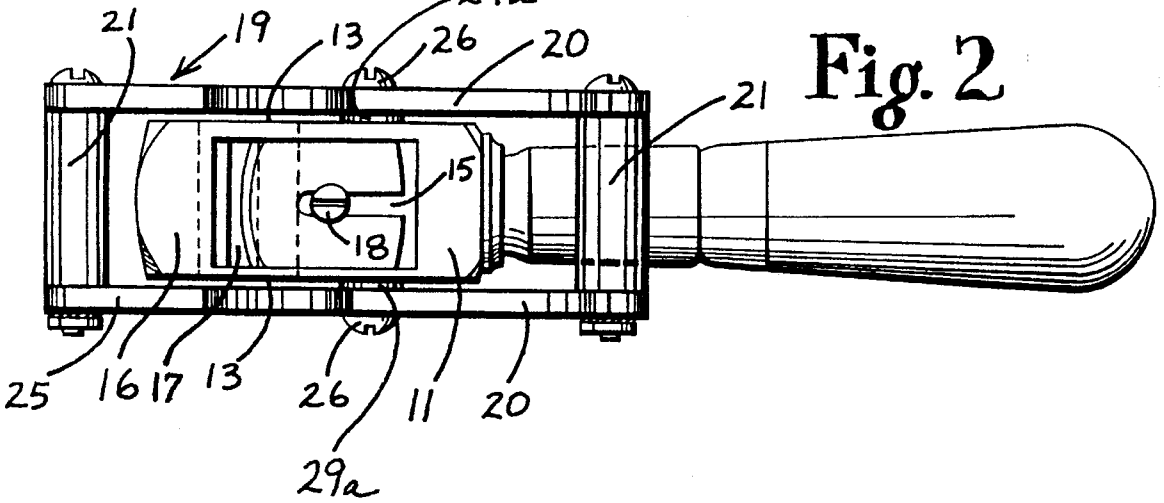
FIG. 2 is a top view of the device shown in FIG. 1.

As used herein, "upwardly" means in a generally vertical direction, and with respect to the novel device, movement of the front end of the cradle and its wings "upwardly" refers to the direction the movement of the front end of the cradle would take with respect to the front side of the body block when it is operatively employed in tapering a work piece.

The term "remaining centered" means, with respect to the work piece in the borehole during tapering operations, that the work piece remains at substantially all times as its radius is reduced with its center of rotation just below the leading edge of the cutting blade.

Turning now to the drawings in which like parts are referred to by like reference numerals, and particularly to FIGS. 1 to 5, the shaft tapering device of the invention is seen to be identified generally by the reference numeral 10. Tapering of a work piece takes place inside the body block 11, inside the borehole 12 that extends transversely between the lateral sides 13. The shaving or cutting is done by a cutting blade 14 positioned in a rather shallow inclined recess 15 in the upper side 16 of the body block 11, the recess 15 inclining downwardly in the direction from the rear to the front of the body block and intersecting the borehole 12 to form an aperture 17 through which the cutting blade 14 extends. The incline angle of the floor of the recess 15 should hold the cutting blade 14 appropriately for the cutting attack on the work piece, as well understood in the art, generally along a line tangential to the surface of the work piece as it is rotated. If the work piece is being turned to a uniform diameter the cutting blade will usually have 90 degree corners at the cutting edge, while a cutting blade for tapering should have rounded corners, such as blade 14 seen in FIG. 5. The cutting blade 14 is secured to the floor of the recess, for example, with a screw such as screw 18. The recess 15 extends nearly from side to side of the body block, or at least sufficiently wide to accommodate a typical cutting blade.

Mounted pivotally to the lateral sides 13 of the body block 11 is a cradle indicated generally by the numeral 19. The cradle 19 is made up of two substantially identical rocker-like members or wings 20 that are held spaced apart by spacer elements or spreaders 21 adjacent the ends of the wings 20. Pivotal mounting of the cradle 19 is achieved by pivotably attaching the respective wings 20 to the respective lateral sides 13 of the body block 11 between the borehole 12 and the rear side 23 of the body block, where the handle 24 is attached. Preferably, the point of pivotal attachment is above the mid-height line of the body block and spaced about the diametric width of the borehole 12 from the nearest edge of the borehole to afford good action in positioning the work piece when the front end 25 of the cradle 19 is being pivoted upwardly to cause the work piece to be turned to a smaller diameter.

The pivotal attachment may be made with screws 26 that extend through smooth bored holes 26*a* in the wings 20 into tapped holes 27 in the body block 11. To prevent "grabbing" by the heads of the screws 26 the wings 20 may have a boss 28 formed around the openings of the bored holes 26*a* on the outer faces of the wings, or a washer 28*a* may simply be used. Similarly, a boss 29 may be formed on the inner face of each wing 20 around the bored hole for the screw 26, or a washer 29*a* used to avoid friction between the wings 20 and the body block 11 during pivoting of the cradle 19.

The spreaders 21, which hold the wings appropriately spaced apart, may each be a simple spacer element that is rod-like or rectangular in section, but with an axial borehole 30 so that a bolt 31 may be inserted therethrough and through boreholes 32 in the opposed end portions of respective wings 20 and secured by a nut 33.

The rearwardly portions 22 of the wings 20 may be upswept, if desired, to allow pivoting thereof downwardly with assurance the rear spreader 21 will not ordinarily strike the handle 24 or the hand holding the handle.

The handle 24 may be firmly attached to the rear side 23 of the body block 11 in most any suitable manner, for example, by a connecting bolt or threaded element 34 that engages a tapped hole in the body block 11, the other end being anchored within the handle in a tapped hole or by being cemented or glued into a longitudinal borehole in the forward part of the handle.

In a critical aspect of the invention, the upper edge 35 of each wing 20 has formed therein an unsymmetrical, J-shaped notch 36 somewhat adjacent the front end 25 of the cradle, i.e., in the forward portion 37 of each wing 20, the notches being substantially identically shaped and located. While the lower edge 38 of each wing is preferably convexly curved about like the rocker of a rocking chair to provide more width adjacent the notch 36, the upper edge 35 may define a more or less straight line except for the notch 36 and the upswept rearward portion 22. The deepest part 39 of each notch 36 is substantially semicircular to readily support a work piece during shaving or turning. The diameter selected is usually about the same as that of the borehole 12, and that is usually dictated by the initial size of the work piece. The notches 36 are preferably formed about one-third to about one-fifth of the length of each wing 20 from the front end thereof, with the semicircular part of the notch 36 being at the requisite spacing from the pivot point of the wing, at the pivot screw 26, to be alignable with the borehole on pivoting the front end of the cradle downwardly.

The front edge 40 of each notch extends away from the semicircular part along about a tangential line therefrom with the line meeting the upper edge 35 of the wing, in both cases, at an angle of a little less than 90 degrees on the order of about 83 to about 88 degrees, slightly forming a hook. The opposing edge 41 of each notch, i.e., the edge inclined rearwardly, and being the long leg of the J-shape, diverges from being co-parallel with the front edge 40 and with very slight continuing curvature extends rearwardly towards the upper edge 35 of the wing and particularly towards a line from the pivot point to the top of the borehole, at an angle in the range of about 40 to about 45 degrees. On selecting the slopes of the front and back edges of the notches appropriately together with the spacing of the notches from the pivot point, it is found that on inserting a work piece in the borehole of the novel shaft tapering device equipped with a cutting blade and rotating the work piece with power means while tipping the front end of the cradle upwardly, the diameter of the work piece is reduced, and as it is reduced, the work piece is guided towards the cutting blade at all times. The front edges of the notches pull the work piece somewhat rearwardly and the inclined opposing rear edges allow the work piece to move somewhat rearwardly appropriately so that the work piece remains with its axial center of rotation just under the cutting edge of the cutting blade for best shaving and turning operations.

The wings 20 need not have any special shape, such as that shown in FIGS. 1, 2, 5 and 6, but may be simply more or less rectangular plates or even pivotal arms each holding sufficient of a plate section for the essential notch that guides the work piece during operations. An equivalent structural element to the notch in a plate or plate section may be a loop formed of heavy gauge wire and firmly mounted on the pivotal arm so that it cannot yield laterally. It is to be specifically understood that for the purposes of the description and claims that the term "notch" is meant to embrace such equivalent structures.

To avoid having the rear spreader strike the handle when the front of the cradle is pivoted upwardly, the handle may be attached at a downward angle from the lower part of the rear side of the body block, thus keeping the handle out of the way.

Figure 3:
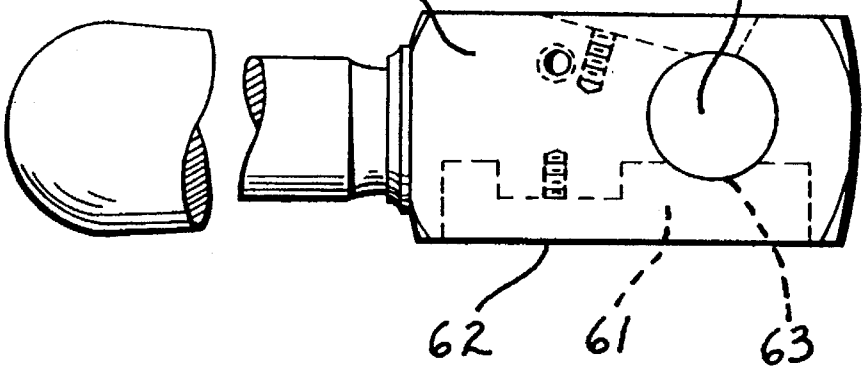
FIG. 3 is a right side elevation of a modified form of the body block of the device shown in FIG. 1, as seen from the opposite side.
Figure 4:
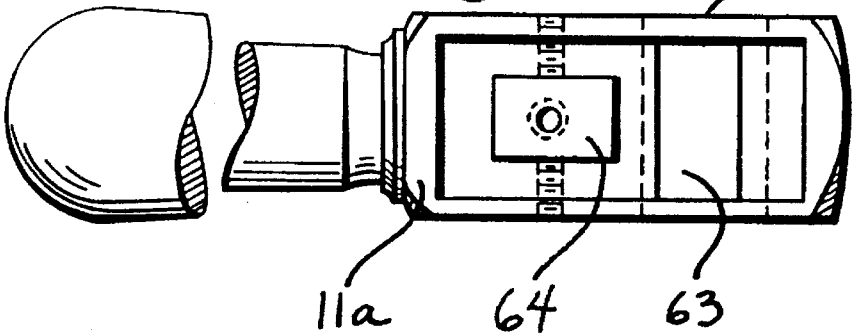
FIG. 4 is a bottom view of the modified body block shown in FIG. 3.

In another embodiment of the present device a modified body block is utilized, such as body block 11*a* as seen in FIGS. 3 and 4 in which a recess 61 nearly the width of the body block is formed in the bottom side 62 thereof, deep enough to intercept the borehole 12*a*, thus forming an aperture 63 communicating with the borehole and providing a ready avenue of escape for the shavings and turnings produced during turning and/or tapering of a work piece. If desired, the recess may be made extensive enough and a shallow boss 64 provided having means for attaching and storing, out of the way, a spare cutting blade or a blade with a different cutting edge profile.

Figures 6, 7:
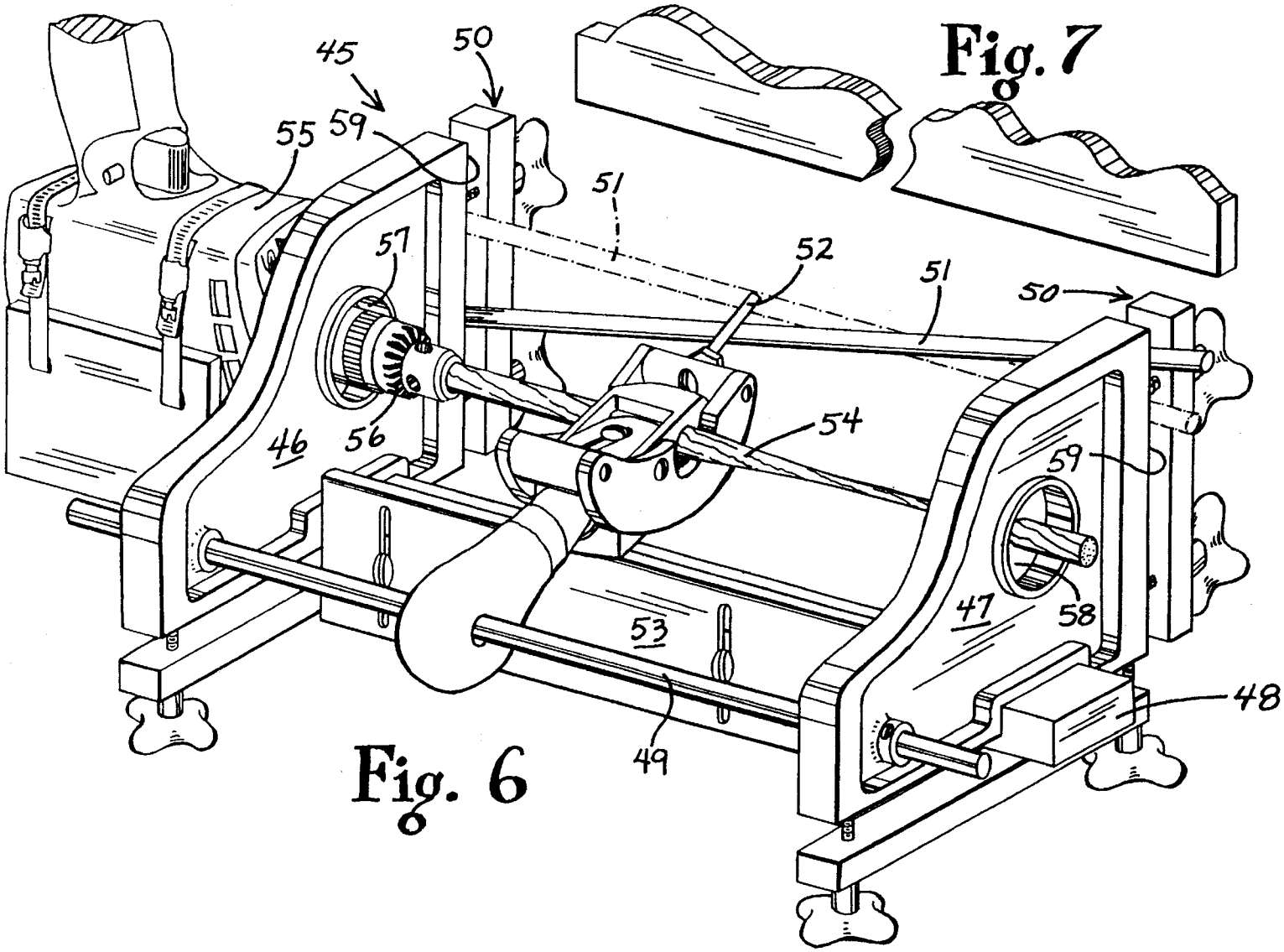
FIG. 6 is a perspective view of an example of a kit according to the invention combining a form of the novel tapering shaft device, having a template follower extending from the forward spreader between the wings, with a novel frame holding a tapering template member between the head stock and the tail stock for the template follower to ride upon.
FIG. 7 is a perspective view, partly truncated and shown in section to foreshorten the view, of a tapering template member that will provide for a variably tapered shaft when used in a frame such as the tapering guide of FIG. 6.

Turning now to FIG. 6, a highly useful, novel tapering guide for use together with a modified form of the shaft tapering device 10*a* of the invention is shown in perspective view with power rotating means for the work piece also shown in the drawing. The tapering guide apparatus, indicated generally by the numeral 45 is seen to have a head stock 46 and a tail stock 47 connected by a longitudinal way 48 and connecting guide rod 49. At the back vertical edges 59, 59*a* of the head stock 46 and the tail stock 47, respectively, are clamps 50 for holding a tapering template member 51 on which rides a template follower rod 52 attached to the modified front spreader 21*a*, which must not be rotatable in its mounting. The tapering template member 51 shown is a rod of uniform diameter that is tipped or tilted vertically as held in the clamps 50. The handle 24*a* of the shaft tapering device 10*a* has been pierced and the connecting guide rod 49 inserted therethrough. A tool support 53 is shown adjustably attached to the longitudinal way 48 and the body block 11*a* of the shaft tapering device is manually slidable along the tool support 53 to achieve uniform tapering as the work piece, here identified by the numeral 54, is rotated. A drill motor 55 is shown supported adjacent the head stock 46 with the chuck 56 of the drill motor extending through a generously wide aperture 57 in the head stock, and the work piece 54 mounted in the chuck 56. The work piece 54 here shown extends through the borehole 12*a* of the body block 11*a* and the notches 36*a* of the wings 20*a* of the shaft tapering device 10*a* and, further, through an aperture 58 in the tail stock which serves as a guide to avoid any large oscillations of the work piece. The dimensions of the handle 24*a*, together with the shaft tapering device 10*a* and the spacing from the connecting guide rod 49 to the axial line of the chuck 56 and work piece 54 must be selected appropriately so that the work piece rotation is centered axially within the borehole 12*a*.

on rotating the work piece 54 in the apparatus by means of the drive means, drill motor 55, as shown, and manually sliding the shaft tapering device 10*a* from left to right along the tool support 53 with the template follower rod 52 riding on the tapering template member 51, the cradle 19*a* is pivoted upwards in a steady manner and the work piece 54 is uniformly tapered smaller and smaller from left to right.

If it is desired to turn the work piece 54 into a shaft of uniform diameter, the template member 51 is simply supported horizontally by the clamps 50 with no tilting aspect, as shown in dotted outline in FIG. 6, and accordingly the cradle 19*a* is not pivoted upon sliding the shaft tapering device along the tool support 53, whereupon a shaft of uniform diameter is obtained.

On the other hand, a variably tapered or shaped shaft may be produced, and reproducibly, upon using as the tapering template member 51 a rigid member, such as that shown in FIG. 7, shaped to provide a cam-like surface on which the template follower rod 52 rides to pivot the cradle 19*a* appropriately up and down as the shaft tapering device 10*a* is moved translationally along the tool support 53 to generate the shape of shaft desired.

It should be understood that most any rotational power means may be used to rotate the work piece when using the present shaft tapering device if portability is not essential, such as a drill press, a lathe motor, or a foot treadle, and the work piece may be mounted in or held by a chuck or lathe or other known mounting device for rotating a work piece. The drill motor provides satisfactory power in many instances but is usually needed for portability.

Figure 5:
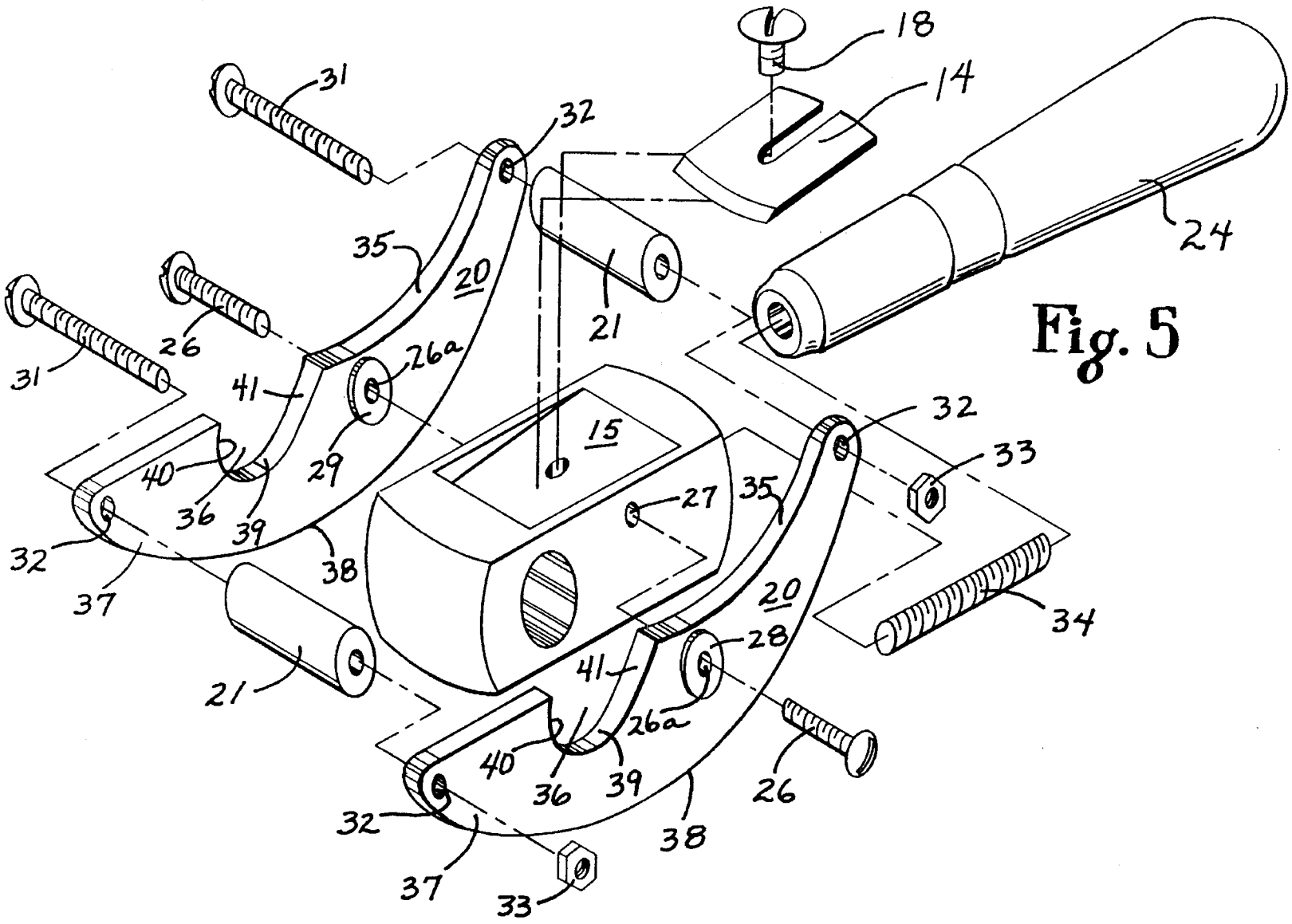
FIG. 5 is an exploded perspective view of the device of FIG. 1, modified to the extent of having round bosses around the apertures through the wings at the pivot point where supporting screws extend into the body block.

While a template follower rod 52 has been shown on the front spreader 21 in FIG. 5 and described, it should be understood that such a template follower rod can be added to the rear spreader and the tapering guide set up to position a tapering template that the template follower rod will ride on at the back of the shaft tapering device. Such a template follower rod, or similar structure, can also be added to the rear spreader and used as a handle to grasp easily instead of the spreader itself in manual operations.

If desired, the pivotal guiding cradle may be cast of metal or formed of plastic, or carved from a single piece of wood, combining the arms and spreaders into a single unit.

A unique feature of the present shaft tapering device is that there is very little moving or advancing of the device towards the work piece, the device moving the work piece towards the cutting blade within the borehole, rather than the usual contrary movement of a cutting blade towards the work piece.

I claim:

1. A shaft tapering device comprising:

a body block having a top side, a bottom side, a front side, a rear side and lateral sides;

a guiding cradle pivotably mounted on the lateral sides of the body block and having front and rear ends; and a handle attached to or adjacent the rear side of the body block;

the body block having a transverse borehole adjacent the front side for receipt of a work piece to be turned and an aperture extending forwardly and downwardly from the top side to intercept the borehole, the aperture being adapted for mounting a cutting blade to extend operatively slightly into the borehole;

the guiding cradle having two arms, each the same length and somewhat longer than the body block and being joined spaced apart by a spreader element at each end, the guiding cradle being pivotably mounted by means of the arms each being attached pivotably to a respective lateral side of the body block at a point between the borehole and the rear side of the body block and about at the level of the top of the borehole, and spaced from the nearest edge of the borehole a distance about equal to the diameter of the borehole;

the arms each being provided with a rearwardly inclined J-shaped support notch at about their mid-length, each notch at its deepest part being nearly semicircular and the defining edge of each notch closest to the front side of the body block extending upwardly flared slightly away from a line tangential to the semicircular deepest part and crossing a line running through the pivotal attachment point and the top of the borehole at an angle of almost 90 degrees, while on the other side of the deepest part the opposing edge flares away, curving slightly from the tangential line and crossing the said line running through the pivotal point at an angle between about 40 and about 45 degrees, the deepest part of each notch having about the same diameter as the borehole of the body block and being substantially alignable therewith on pivoting the arms of the guiding cradle.

2. The shaft tapering device of claim 1 wherein the borehole is located about 20 to about 33 percent of the length of the body block from the front side.

3. The shaft tapering device of claim 1 wherein the borehole is located about 25 to about 30 percent of the length of the body block from the front side.

4. The shaft tapering device of claim 1 wherein the arms are plate-like wing members and are each pivotable about said point which is located about 55 percent of the length of the body block from the rear side thereof to the nearest edge of the borehole.

5. The shaft tapering device of claim 4 wherein the wing members have top and bottom edges, the bottom edges being rounded convexly in a "rocker"-like curve, and the top edges being substantially straight except for the notches.

6. The shaft tapering device of claim 5 wherein the wing members are each shaped with upswept rear end portions whereby the rear spreader does not strike the handle while pivoting the front ends upwardly.

7. The shaft tapering device of claim 1 wherein the forward defining edges of the notches in the arms are inclined so as to move a work piece in the borehole slightly rearwardly towards a cutting blade held in the body block aperture as tapering to a smaller diameter proceeds during pivoting of the cradle as the work piece is rotated.

8. The shaft tapering device of claim 1 wherein the rear defining edges of the notches in the arms are inclined away from the tangential line sufficiently to permit a work piece being rotated and tapered smaller to move slightly rearwardly of the body block and remain centered with respect to a cutting blade in the aperture in the body block.

9. The shaft tapering device of claim 1 wherein the body block is provided with a recess formed in the bottom side of the body block, the recess being sufficiently deep to form a second aperture communicating with the borehole, the second aperture being of sufficient width to permit ready discharge of shavings and turnings.

10. The shaft tapering device as in claim 9 wherein the recess has a floor and a boss is formed on the floor of the recess, the boss having a height less than the remaining peripheral body wall portions, and means for attaching a cutting blade to the boss and out of the way when not in use.

11. The shaft tapering device as in claim 1 wherein a cutting blade is mounted in an inclined recess in the top side, the angle of a floor of the recess being such that the blade addresses a work piece in the borehole approximately tangentially line to the surface of the work piece.

12. The shaft tapering device as in claim 11 wherein a cutting edge of the cutting blade has rounded corners for tapering operations.

13. The shaft tapering device of claim 1 having a template follower in the form of a rod rigidly attached to the spreader forwardmost of the handle about midway between the wing members and extending forwardly of the spreader and normal thereto.

14. A kit for tapering a shaft of turnable material comprising:

the shaft tapering device of claim 13; and a tapering guide comprising:

a frame having a longitudinal way with first and second ends, a head stock at the first end and a tail stock at the second end, and an elongated tapering template member attached to and supported by both the head stock and the tail stock so as to incline from the one to the other, and a supporting element extending between the head stock and the tail stock and having a surface upon which the shaft tapering device can be positioned with the template follower resting on the tapering template member and along which surface the shaft tapering device may be slid during tapering of a work piece with the template follower simultaneously sliding along the tapering template element.

15. The kit as in claim 14 wherein the tapering template member is a rod of uniform diameter.

16. The kit as in claim 14 wherein the tapering template member is a rigid elongated element with an irregular surface.

17. The kit as in claim 14 wherein the frame is provided with means for mounting a motor drive with a chuck to support and rotate a work piece to be turned, the head stock and the tail stock having opposed aligned respective apertures for the chuck and a tail end of the work piece to extend through, respectively.

18. The kit as in claim 17 wherein the mount for a motor drive is releasable and the motor drive is a portable drill motor.

19. The kit as in claim 14 wherein the frame is portable.

20. A method of tapering a work piece of turnable material comprising:

providing a body block with a transverse borehole to receive the work piece, the body block having a top side, a rear side, a front side and lateral sides, and an aperture extending downwardly from the top side to the borehole and a cutting blade positioned in the aperture extending operatively into the borehole; and providing two pivotal guiding arms pivoted at the lateral sides of the body block, each arm having a notch shaped and positioned aligned with the borehole to guide the work piece towards the cutting blade during tapering while the work piece is rotating;

and further providing means for rotating the work piece, the rotating means having end-grasping mounting means;

inserting the work piece into the end-grasping mounting means and through the borehole of the body block and the aligned notches of the pivotal guiding means; and pivoting the pivotal guiding arms to move the work piece towards the cutting blade during rotation of the work piece by the means for rotation while the pivotal guiding arms means maintain the work piece substantially centered under a cutting edge of the cutting blade during tapering.

* * * * *